US009899146B2

(12) United States Patent
Sugahara

(10) Patent No.: US 9,899,146 B2
(45) Date of Patent: Feb. 20, 2018

(54) SIGNAL TRANSFER DEVICE

(71) Applicant: FUJI ELECTRIC CO., LTD., Kawasaki-shi (JP)

(72) Inventor: Satoshi Sugahara, Matsumoto (JP)

(73) Assignee: FUJI ELECTRIC CO., LTD., Kawasaki-Shi (JP)

( * ) Notice: Subject to any disclaimer, the term of this patent is extended or adjusted under 35 U.S.C. 154(b) by 263 days.

(21) Appl. No.: 14/942,764

(22) Filed: Nov. 16, 2015

(65) Prior Publication Data

US 2016/0155565 A1 Jun. 2, 2016

(30) Foreign Application Priority Data

Dec. 1, 2014 (JP) ..... 2014-243529

(51) Int. Cl.

| | |
|---|---|
| ***H01F 27/28*** | (2006.01) |
| ***H01F 27/29*** | (2006.01) |
| ***H01F 38/14*** | (2006.01) |
| ***H01F 19/08*** | (2006.01) |

(52) U.S. Cl.

CPC ..... *H01F 38/14* (2013.01); *H01F 19/08* (2013.01); *H01F 27/28* (2013.01); *H01F 27/29* (2013.01); *H01F 2019/085* (2013.01); *H01F 2027/2809* (2013.01); *H01F 2038/143* (2013.01)

(58) Field of Classification Search

None

See application file for complete search history.

(56) References Cited

U.S. PATENT DOCUMENTS

| | | | | |
|---|---|---|---|---|
| 5,892,667 | A | 4/1999 | Glasband et al. | |
| 6,278,266 | B1 | 8/2001 | Glasband | |
| 2003/0042571 | A1 | 3/2003 | Chen et al. | |
| 2004/0140877 | A1 | 7/2004 | Nakao et al. | |
| 2004/0196132 | A1 | 10/2004 | Yu et al. | |
| 2009/0322380 | A1* | 12/2009 | Yanagishima | H02M 1/08 327/73 |
| 2011/0291819 | A1* | 12/2011 | Kaeriyama | H01L 23/48 340/286.01 |

(Continued)

FOREIGN PATENT DOCUMENTS

| | | |
|---|---|---|
| EP | 0410526 A1 | 1/1991 |
| JP | H03-44507 A | 2/1991 |

(Continued)

*Primary Examiner* — Jared Fureman
*Assistant Examiner* — Aqeel Bukhari
(74) *Attorney, Agent, or Firm* — Rabin & Berdo, P.C.

(57) ABSTRACT

In order to transfer a signal for driving a high-side semiconductor power switch, a signal transfer device includes a transmitting circuit, a receiving circuit, and an insulating transformer provided between the transmitting circuit and the receiving circuit. In the insulating transformer, a secondary side of a set transformer part and a secondary side of a reset transformer part are magnetically coupled. The magnetic coupling direction is formed so that a secondary-side terminal of the transformer part and a secondary-side terminal of the transformer part can have polarities reverse to each other. Thus, it is possible to provide a signal transfer device for transferring a signal through an insulating transformer, in which occurrence of common-mode noise can be suppressed and a countermeasure circuit against the noise can be simplified.

20 Claims, 14 Drawing Sheets

VIEW SHOWING CONFIGURATION OF SIGNAL TRANSFER DEVICE ACCORDING TO FIRST EMBODIMENT OF THE INVENTION

(56) References Cited

U.S. PATENT DOCUMENTS

| | | | | |
|---|---|---|---|---|
| 2012/0020419 | A1 | 1/2012 | Kaeriyama | |
| 2013/0055052 | A1 | 2/2013 | Kaeriyama | |
| 2013/0135076 | A1 | 5/2013 | Nagase | |
| 2014/0103736 | A1* | 4/2014 | Akahane | H01F 19/04 307/104 |

FOREIGN PATENT DOCUMENTS

| | | | |
|---|---|---|---|
| JP | 2012-182740 | A | 9/2012 |
| JP | 2013-051547 | A | 3/2013 |
| JP | 2013-115131 | A | 6/2013 |

* cited by examiner

VIEW SHOWING CONFIGURATION OF SIGNAL TRANSFER DEVICE ACCORDING TO FIRST EMBODIMENT OF THE INVENTION

VIEW SHOWING BASIC OPERATION WAVEFORM OF SIGNAL TRANSFER DEVICE ACCORDING TO FIRST EMBODIMENT OF THE INVENTION SHOWN IN FIG.1

VIEW SHOWING CONFIGURATION OF SIGNAL TRANSFER DEVICE ACCORDING TO SECOND EMBODIMENT OF THE INVENTION

VIEW SHOWING CONFIGURATION EXAMPLE (EXAMPLE 1)
IN WHICH TRANSFORMER IN FIRST EMBODIMENT
SHOWN IN FIG.1 IS MADE UP OF SPIRAL COILS

VIEW SHOWING CONFIGURATION EXAMPLE (EXAMPLE 2) IN WHICH TRANSFORMER IN FIRST EMBODIMENT SHOWN IN FIG.1 IS MADE UP OF SPIRAL COILS

VIEW SHOWING CONFIGURATION EXAMPLE (EXAMPLE 3) IN WHICH TRANSFORMER IN SECOND EMBODIMENT SHOWN IN FIG.3 IS MADE UP OF SPIRAL COILS

VIEW SHOWING CONFIGURATION EXAMPLE (EXAMPLE 4) IN WHICH TRANSFORMER IN SECOND EMBODIMENT SHOWN IN FIG.3 IS MADE UP OF SPIRAL COILS

VIEW SHOWING CONFIGURATION EXAMPLE (EXAMPLE 5) IN WHICH TRANSFORMER IN SECOND EMBODIMENT SHOWN IN FIG.3 IS MADE UP OF SPIRAL COILS

VIEW SHOWING CONFIGURATION EXAMPLE (EXAMPLE 6) IN WHICH TRANSFORMER IN FIRST EMBODIMENT SHOWN IN FIG.1 IS MADE UP OF SOLENOID COILS

VIEW SHOWING CONFIGURATION EXAMPLE (EXAMPLE 7) IN WHICH TRANSFORMER IN SECOND EMBODIMENT SHOWN IN FIG.3 IS MADE UP OF SOLENOID COILS

VIEW SHOWING CONFIGURATION EXAMPLE OF TYPICAL SWITCHING POWER SUPPLY CONSTITUTED BY SEMICONDUCTOR POWER SWITCHES ONE OF WHICH INCLUDES SIGNAL TRANSFER DEVICE TRANSFERRING SIGNAL THROUGH INSULATING TRANSFORMER

VIEW SHOWING CONFIGURATION OF BACKGROUND-ART SIGNAL TRANSFER DEVICE

VIEW SHOWING IDEAL OPERATION WAVEFORM
OF BACKGROUND-ART SIGNAL TRANSFER DEVICE SHOWN IN FIG.12

OPERATION WAVEFORM DIAGRAM FOR EXPLAINING PROBLEM
OF BACKGROUND-ART SIGNAL TRANSFER DEVICE SHOWN IN FIG.12

SIGNAL TRANSFER DEVICE

CROSS-REFERENCE TO RELATED APPLICATION(S)

This non-provisional application for a U.S. patent claims the benefit of priority of JP PA 2014-243529 Dec. 4, 2014, the entire contents of which is hereby incorporated by reference.

BACKGROUND OF THE INVENTION

1. Field of the Invention

The present invention relates to a signal transfer device for driving a semiconductor power switch such as an IGBT (Insulated Gate Bipolar Transistor) provided on a high side of a switching power supply, an inverter or any of various drive circuits including a semiconductor switching element.

2. Description of the Background Art

FIG. 11 is a view showing a configuration example of a typical switching power supply constituted by semiconductor power switches one of which includes a signal transfer device transferring a signal through an insulating transformer. For example, an IGBT, an MOSFET (Metal Oxide Field-Effect Transistor) etc. can be used as each of the semiconductor power switches. In a circuit for switching the semiconductor power switches, a high-side semiconductor power switch MH is driven to turn ON/OFF in accordance with an output from the signal transfer device through the insulating transformer.

FIG. 12 is a view showing the configuration of a background-art signal transfer device. In FIG. 12, the background-art signal transfer device is constituted by a transmitting circuit 200, a receiving circuit 300, and an insulating transformer 100 provided between the transmitting circuit 200 and the receiving circuit 300. In addition, a driver 400 is connected to a rear end of the receiving circuit 300. Further, the insulating transformer 100 has a configuration in which two transformer parts, i.e. a transformer part 1 and a transformer part 2, are used so that a signal (set signal) indicating a turn-ON timing of the semiconductor power switch MH can be transmitted to an R1 terminal of the receiving circuit 300 through the transformer part 1 and a signal (reset signal) indicating a turn-OFF timing of the semiconductor power switch MH can be transmitted to an R2 terminal of the receiving circuit 300 through the transformer part 2. As shown in FIG. 12, configuration is made so that output terminals of secondary-side windings of the transformer part 1 and the transformer part 2 can have the same magnetic polarity (voltages in the output terminals can change in the same direction when a magnetic flux changes in one and the same direction). The background-art signal transfer device in FIG. 12 drives the semiconductor power switch MH on the high side of the switching circuit shown in FIG. 11, through the driver 400.

FIG. 13 is a view showing an ideal operation waveform of the background-art signal transfer device shown in FIG. 12. FIG. 14 is an operation waveform view for explaining a problem of the background-art signal transfer device shown in FIG. 12. Since FIG. 14 partially overlaps with FIG. 13, operation of the background-art signal transfer device will be described with reference to FIG. 11 and FIG. 14.

When the high-side power switch MH shown in FIG. 11 is driven, a GND2 potential in FIG. 12 and FIG. 14 fluctuates in accordance with ON/OFF operations of power switches MH and ML. When the power switch MH turns OFF and the power switch ML turns ON due to an output from the signal transfer device, the GND2 potential drops from a high-side power supply voltage to GND1, as shown in FIG. 14. Due to the fluctuation of the GND2, plus common-mode noises ($N1^+$ and $N2^+$) occur in the signal terminals R1 and R2 of the receiving circuit 300 side through parasitic capacitances (not shown).

On the other hand, when the power switch ML turns OFF and the power switch MH turns ON due to an output from the signal transfer device, the GND2 potential rises from the GND1 to the high-side power supply voltage. Due to the fluctuation of the GND2, minus common-mode noises ($N1^-$ and $N2^-$) occur in the signal terminals R1 and R2 of the receiving circuit 300 side through the parasitic capacitances (not shown).

In some cases, the high-side power switch MH shown in FIG. 11 may turn ON/OFF by mistake due to any of the aforementioned common-mode noises.

In the background art in order to prevent malfunction from being caused by common-mode noise, a circuit (not shown) for detecting the common-mode noise and suppressing generation of a false pulse is usually mounted inside the receiving circuit 300.

JP-A-2013-51547 discloses a configuration in which a detection circuit for preventing malfunction from being caused by common-mode noise is mounted (see Paragraph [0058], FIG. 5).

JP-A-3-44507 discloses a circuit configuration for preventing malfunction from being caused by common-mode noise (see FIG. 1).

The aforementioned configuration described in JP-A-2013-51547 has a problem that a receiving circuit becomes complicated and a malfunction preventing effect deteriorates as the fluctuation width of GND2 increases.

In addition, the configuration described in JP-A-3-44507 also has a problem that a receiving circuit becomes complicated because a device such as a differential amplifier for canceling common-mode noise by subtraction of a common-mode voltage signal is required on the side of the receiving circuit.

Therefore, an object of the invention is to provide a signal transfer device for transferring a signal through an insulating transformer, in which occurrence of common-mode noise can be suppressed and a countermeasure circuit against the noise can be simplified.

SUMMARY OF THE INVENTION

In order to solve the foregoing problem, according to a first configuration of the invention, there is provided a signal transfer device which transfers a signal through a transformer, wherein: a secondary-side winding of one transformer part of the transformer connected to a set-side input terminal of a receiving circuit and a secondary-side winding of another transformer part of the transformer connected to a reset-side input terminal of the receiving circuit are magnetically coupled to each other so densely that a magnetic flux interlinking with one of the secondary-side windings can also interlink with the other; and the two secondary-side windings are connected to the receiving circuit so that the set-side input terminal and the reset-side input terminal of the receiving circuit can have magnetic polarities reverse to each other.

According to a second configuration of the invention, there is provided a signal transfer device according to the first configuration of the invention, wherein: the two secondary-side windings are wound in one and the same direction but signal terminals and ground terminals of the two secondary-side windings are reversed to each other so that the set-side input terminal and the reset-side input terminal of the receiving circuit can have magnetic polarities reverse to each other.

According to a third configuration of the invention, there is provided a signal transfer device according to the second configuration of the invention, wherein: the transformer is made up of rectangular, circular, elliptical or polygonal spiral coils.

According to a fourth configuration of the invention, there is provided a signal transfer device according to the second configuration of the invention, wherein: the transformer is made up of rectangular, circular, elliptical or polygonal solenoid coils.

According to a fifth configuration of the invention, there is provided a signal transfer device according to the second configuration of the invention, wherein: the transformer is made up of solenoid coils in which rectangular, circular, elliptical or polygonal spiral coils are laminated.

According to a sixth configuration of the invention, there is provided a signal transfer device according to the first configuration of the invention, wherein: the two secondary-side windings are wound in reverse directions so that the set-side input terminal and the reset-side input terminal of the receiving circuit can have magnetic polarities reverse to each other.

According to a seventh configuration of the invention, there is provided a signal transfer device according to the sixth configuration of the invention, wherein: the transformer is made up of rectangular, circular, elliptical or polygonal spiral coils.

According to an eighth configuration of the invention, there is provided a signal transfer device according to the sixth configuration of the invention, wherein: the transformer is made up of rectangular, circular, elliptical or polygonal solenoid coils.

According to a ninth configuration of the invention, there is provided a signal transfer device according to the sixth configuration of the invention, wherein: the transformer is made up of solenoid coils in which rectangular, circular, elliptical or polygonal spiral coils are laminated.

According to a tenth configuration of the invention, there is provided a signal transfer device according to the second or sixth configuration of the invention, wherein: a primary-side winding is formed out of a single coil or out of a plurality of coils connected in series or in parallel.

According to an eleventh configuration of the invention, there is provided a signal transfer device according to the tenth configuration of the invention, wherein: the transformer is made up of rectangular, circular, elliptical or polygonal spiral coils.

According to a twelfth configuration of the invention, there is provided a signal transfer device according to the tenth configuration of the invention, wherein: the transformer is made up of rectangular, circular, elliptical or polygonal solenoid coils.

According to a thirteenth configuration of the invention, there is provided a signal transfer device according to the tenth configuration of the invention, wherein: the transformer is made up of solenoid coils in which rectangular, circular, elliptical or polygonal spiral coils are laminated.

According to a fourteenth configuration of the invention, there is provided a signal transfer device according to the first configuration of the invention, wherein: a primary-side winding is formed out of one coil, and a signal transmitted to the set-side input terminal of the receiving circuit and a signal transmitted to the reset-side input terminal of the receiving circuit are inputted to opposite end terminals of the primary-side winding.

According to a fifteenth configuration of the invention, there is provided a signal transfer device according to the second or fourteenth configuration of the invention, wherein: an intermediate tap is provided at a connection point at which one ends of the two secondary-side windings are connected to each other, and the other ends of the two secondary-side windings are connected to the set-side input terminal and the reset-side input terminal of the receiving circuit respectively.

According to the invention, it is possible to suppress occurrence of common-mode noise and simplify a countermeasure circuit against the noise in the signal transfer device transferring a signal through the insulating transformer.

DETAILED DESCRIPTION OF THE INVENTION

Embodiments of the invention will be described below in detail.

Embodiments

A signal transfer device according to each of embodiments of the invention has a basic configuration in which a secondary-side set winding and a secondary-side reset winding are magnetically coupled to thereby cancel in-phase changes in set and reset signals. When the configuration is made thus, a common mode which could occur in signal terminals R1 and R2 of a receiving circuit in the signal transfer device having the background-art configuration can be suppressed. Accordingly, it is possible to attain a function or an effect that a common-mode rejection unit (not shown) in a subsequent stage which was required in the background-art configuration can be dispensed with or the configuration of the common-mode rejection unit (not shown) can be simplified.

Embodiment 1

Figure 1:
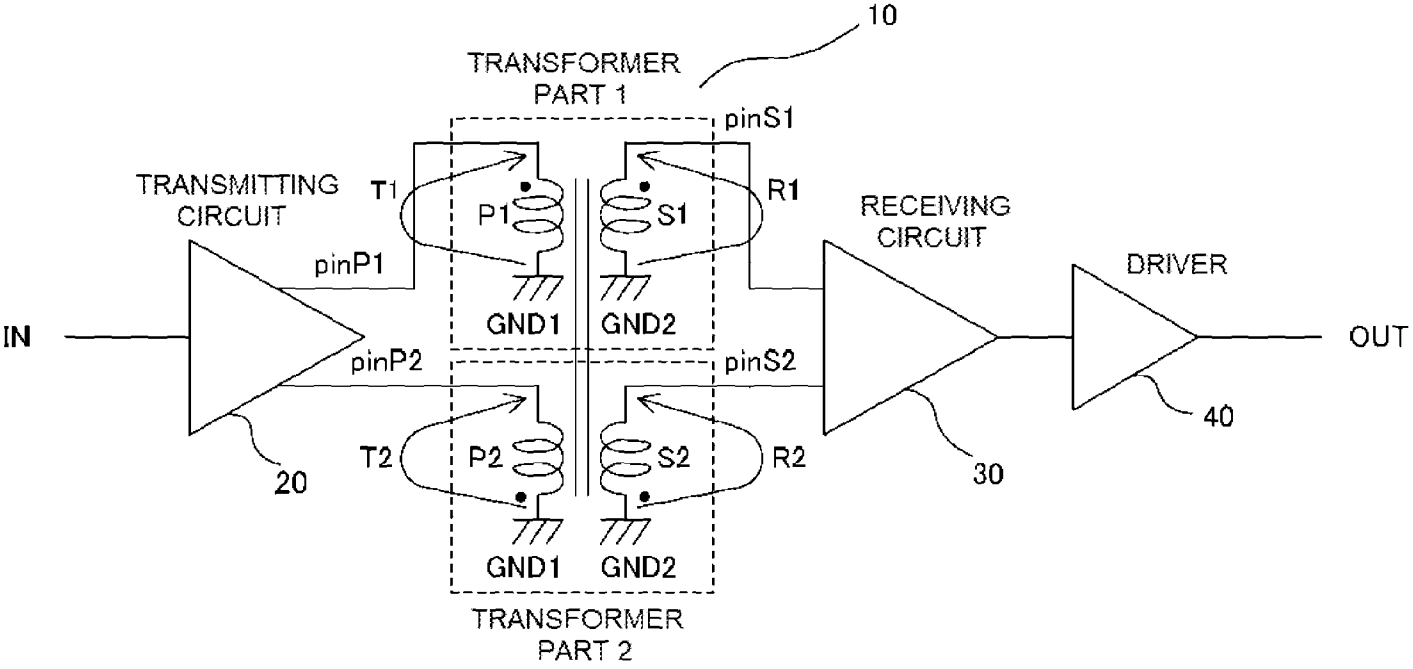
FIG. 1 is a view showing the configuration of a signal transfer device according to a first embodiment of the invention.

FIG. 1 is a view showing the configuration of a signal transfer device according to a first embodiment of the invention. The signal transfer device according to the first embodiment shown in FIG. 1 serves for driving a high-side semiconductor power switch (not shown) of a switching power supply, an inverter, any of various driving circuits, etc. In order to transfer a signal for driving the high-side semiconductor power switch, the signal transfer device according to the first embodiment is configured to include a transmitting circuit 20, a receiving circuit 30, and an insulating transformer 10 provided between the transmitting circuit 20 and the receiving circuit 30.

As shown in FIG. 1, the insulating transformer 10 provided between the transmitting circuit 20 and the receiving circuit 30 has two transformer parts (a transformer part 1 and a transformer part 2) so that the insulating transformer 10 can operate to transmit a signal (set signal) indicating a turn-ON timing through the transformer part 1 and transmit a signal (reset signal) indicating a turn-OFF timing through the transformer part 2.

In the insulating transformer 10 in FIG. 1, a secondary side (S1) of the set transformer part 1 and a secondary side (S2) of the reset transformer part 2 are magnetically coupled. The magnetic coupling direction is formed so that a secondary-side terminal (pinS1) of the transformer part 1 and a secondary-side terminal (pinS2) of the transformer part 2 can have reverse polarities (voltages in the output terminals can change in opposite directions to each other when a magnetic flux changes). Specifically, a secondary-side set winding (S1) and a secondary-side reset winding (S2) are wound densely to share a core (including an air-core) so that a magnetic flux interlinking with one of the secondary-side set winding (S1) and the secondary-side reset winding (S2) can also interlink with the other of the secondary-side set winding (S1) and the secondary-side reset winding (S2). The winding direction of the secondary-side winding (S1) of the set-side transformer part 1 and the winding direction of the secondary-side winding (S2) of the reset-side transformer part 2 are made one and the same.

That is, of two pairs of secondary-side terminals (two GND2 and two signal terminals (set and reset terminals)), the placement of one GND2 and one signal terminal (set or reset terminal) is made reverse to the placement of the secondary-side terminals (the other GND2 and the other signal terminal (reset or set terminal)) of the other transformer part so that the secondary-side terminal (pinS1) of the set-side transformer part 1 connected to the set terminal (R1) of the receiving circuit 30 and the secondary-side terminal (pinS2) of the reset-side transformer part 2 connected to the reset terminal (R2) of the receiving circuit 30 are magnetically coupled reversely. Alternatively, the placements of the secondary-side terminals (pinS1 and pinS2) of the two transformer parts (the set transformer part 1 and the reset transformer part 2) are not reversed but the winding direction of the set-side secondary-side winding (S1) and the winding direction of the reset-side secondary-side winding (S2) are reserved so that the terminals can be magnetically coupled with reverse polarities.

Figure 2:
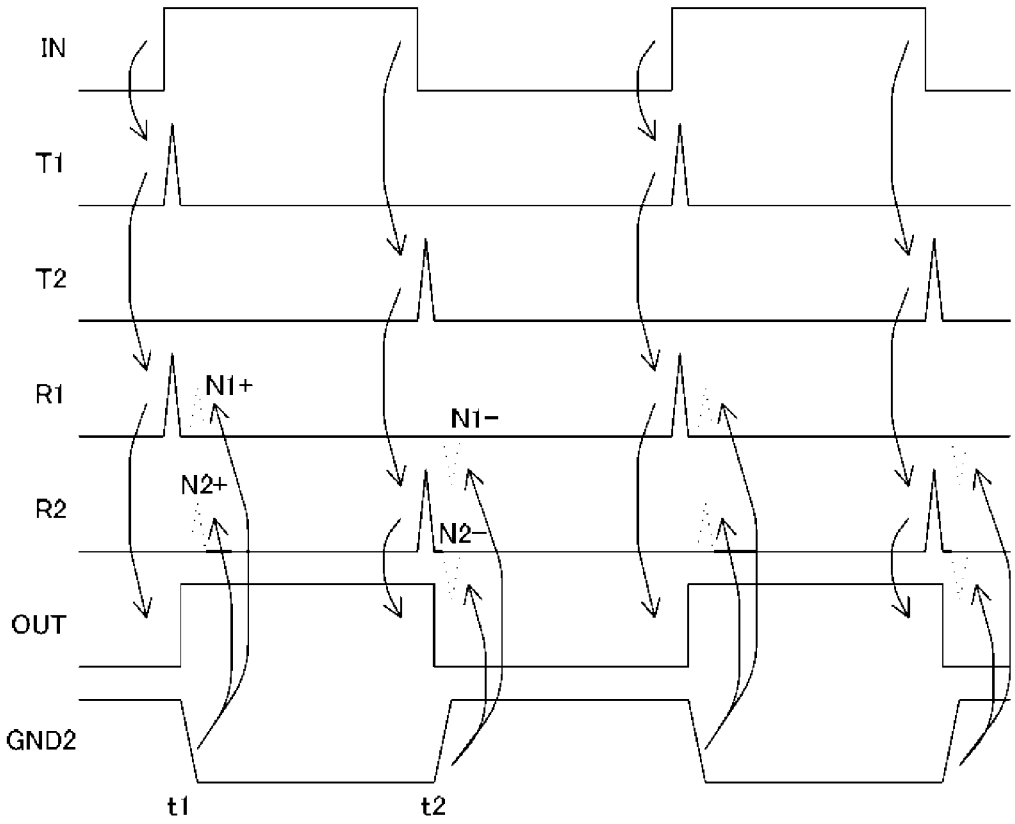
FIG. 2 is a view showing a basic operation waveform of the signal transfer device according to the first embodiment of the invention shown in FIG. 1.
Figure 14:
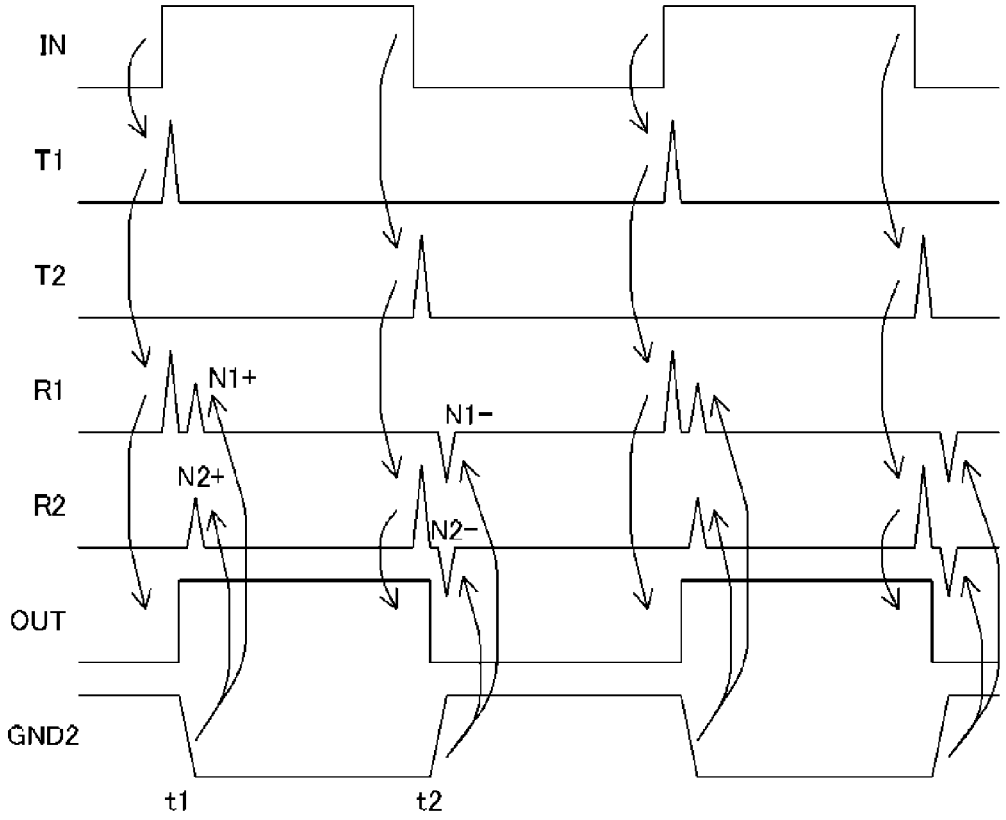
FIG. 14 PRIOR ART
FIG. 14 is an operation waveform diagram for explaining a problem of the background-art signal transfer device shown in FIG. 12.

FIG. 2 is a view showing an operation waveform of the signal transfer device according to the first embodiment of the invention shown in FIG. 1. A basic operation of the signal transfer device according to the first embodiment of the invention will be described with reference to FIG. 2. The operation waveform of the background-art signal transfer device shown in FIG. 14 will be referred to here for suitable comparison.

Description about FIG. 1 and FIG. 2 will be made in detail as follows. That is, a signal for turning ON/OFF the semiconductor power switch (not shown) such as an IGBT (Insulated Gate Bipolar Transistor) is inputted to an IN terminal of the transmitting circuit 20 in FIG. 1. When the transmitting circuit 20 outputs a set signal (T1) at a time t1 in FIG. 2 which is a leading edge timing of the signal of the IN terminal, a set signal (R1) is received by the receiving circuit 30 through the transformer part 1 at the time t1 in FIG. 2.

When the transmitting circuit 20 in FIG. 1 outputs a reset signal (T2) at a time t2 in FIG. 2 which is a trailing edge timing of the signal of the IN terminal, a reset signal (R2) is received by the receiving circuit 30 through the transformer part 2 at the time t2 in FIG. 2.

The receiving circuit 30 in FIG. 1 generates pulses OUT changing over between H (High) and L (Low) at receiving timings of the set signal (R1) and the reset signal (R2), and supplies the generated pulses OUT to a driver 40 in FIG. 1. The driver 40 outputs the pulses for driving the semiconductor power switch (not shown) to a gate of the semiconductor power switch (not shown).

In the signal transfer device according to the first embodiment of the invention, the transformer parts are magnetically coupled with reverse polarities. Occurrence of common-mode noises which would occur in the secondary-side windings as in the background art can be therefore suppressed. That is, even when common-mode noises occur due to sudden changes in the GND2 potentials and the potentials of the signal terminals R1 and R2 tend to change in the same direction, magnetic fluxes occurring in the secondary-side windings act to cancel the changes of the potentials of the mated terminals respectively. Accordingly, occurrence of common-mode noises can be suppressed. Therefore, a common-mode rejection unit (not shown) in a subsequent stage can be dispensed with or the configuration of the common-mode rejection unit (not shown) can be simplified.

Embodiment 2

Figure 3:
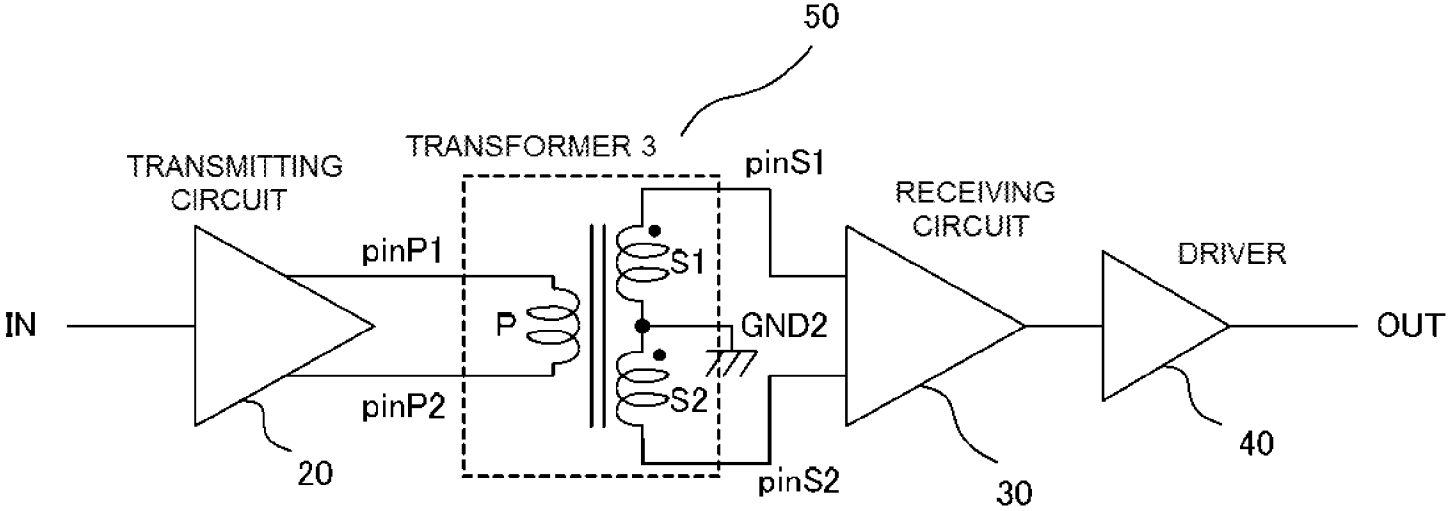
FIG. 3 is a view showing the configuration of a signal transfer device according to a second embodiment of the invention.

FIG. 3 is a view showing the configuration of a signal transfer device according to a second embodiment of the invention. The signal transfer device according to the second embodiment shown in FIG. 3 serves for driving a high-side semiconductor power switch (not shown) of a switching power supply, an inverter, any of various driving circuits, etc. in the same manner as the signal transfer device shown in FIG. 1. In order to transfer a signal for driving the high-side semiconductor power switch, the signal transfer device according to the second embodiment is configured to include a transmitting circuit 20, a receiving circuit 30 and an insulating transformer 50 provided between the transmitting circuit 20 and the receiving circuit 30.

The configuration of the insulating transformer 50 of the signal transfer device according to the second embodiment in FIG. 3 is different from the configuration of the insulating transformer 10 of the signal transfer device according to the first embodiment in FIG. 1 as follows. That is, in the configuration of the insulating transformer 50 shown in FIG. 3, the number of primary-side windings formed in a transformer 3 is one, and an intermediate tap is provided between secondary-side windings and connected to GND2. Here, opposite ends of the primary-side winding serve as terminals to which a set signal and a reset signal are inputted from the transmitting circuit 20 respectively. In addition, the secondary-side windings may be regarded as a single secondary-side winding in which the two GND-side terminals of the secondary-side windings shown in FIG. 1 are connected to each other and an intermediate tap is provided in the connection point. Since the remaining configuration is the same as the configuration of the insulating transformer 10 of the signal transfer device according to the first embodiment shown in FIG. 1, its description will be omitted here.

Transformer Coil Patterns

Figure 4:
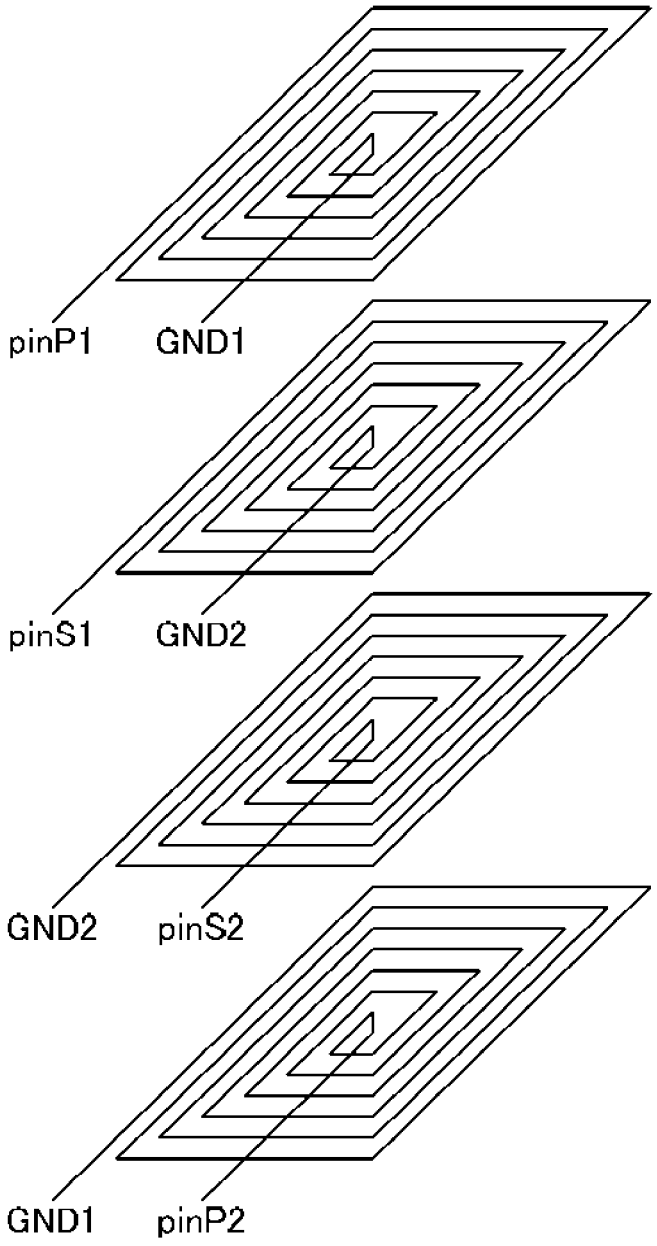
FIG. 4 is a view showing a configuration example (Example 1) in which a transformer in the first embodiment shown in FIG. 1 is made up of spiral coils.

FIG. 4 is a view showing a configuration example 1 in which the transformer according to the first embodiment shown in FIG. 1 is made up of spiral coils. Although each coil shown in FIG. 4 has a rectangular coil pattern, it may have a circular, elliptical or polygonal coil pattern. The winding directions of the primary-side and secondary-side windings of the coils are made common but the terminals disposed on the set side are made reverse to the terminals disposed on the reset side.

Figure 5:
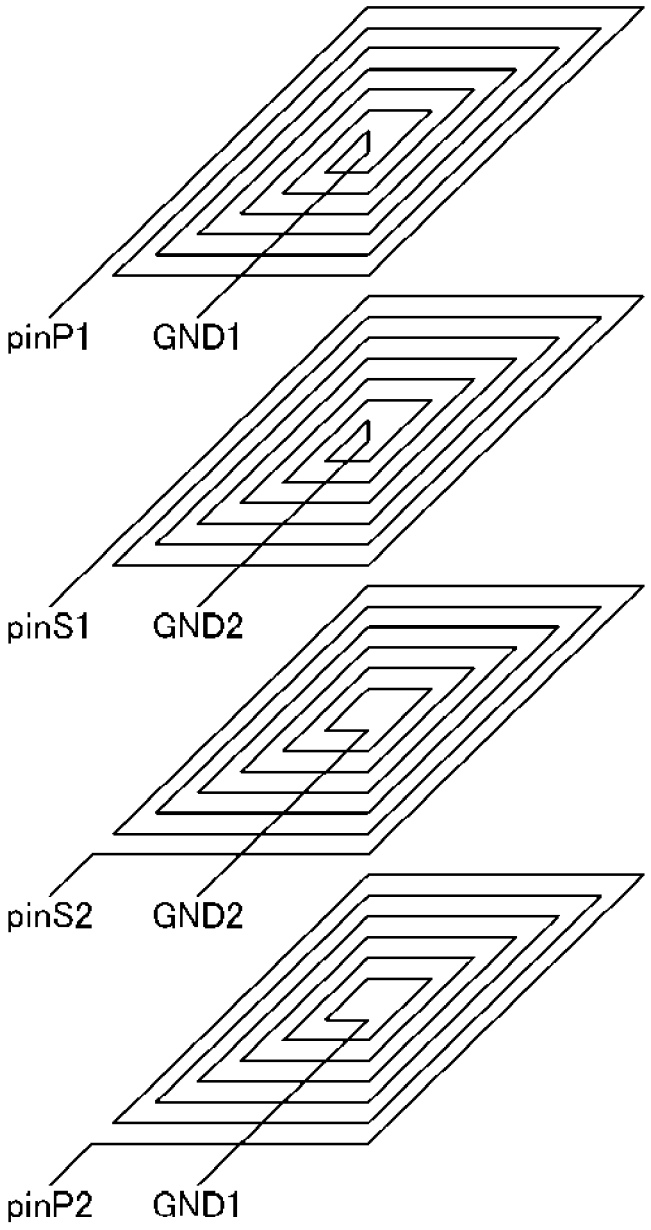
FIG. 5 is a view showing a configuration example (Example 2) in which a transformer in the first embodiment shown in FIG. 1 is made up of spiral coils.

FIG. 5 is a view showing a configuration example 2 in which the transformer according to the first embodiment shown in FIG. 1 is made up of spiral coils. Although each coil shown in FIG. 5 has a rectangular coil pattern, it may have a circular, elliptical or polygonal coil pattern. The winding directions of the primary-side and secondary-side windings of the coils are made reverse but the terminals disposed on the set side are made common to the terminals disposed on the reset side.

Figure 6:
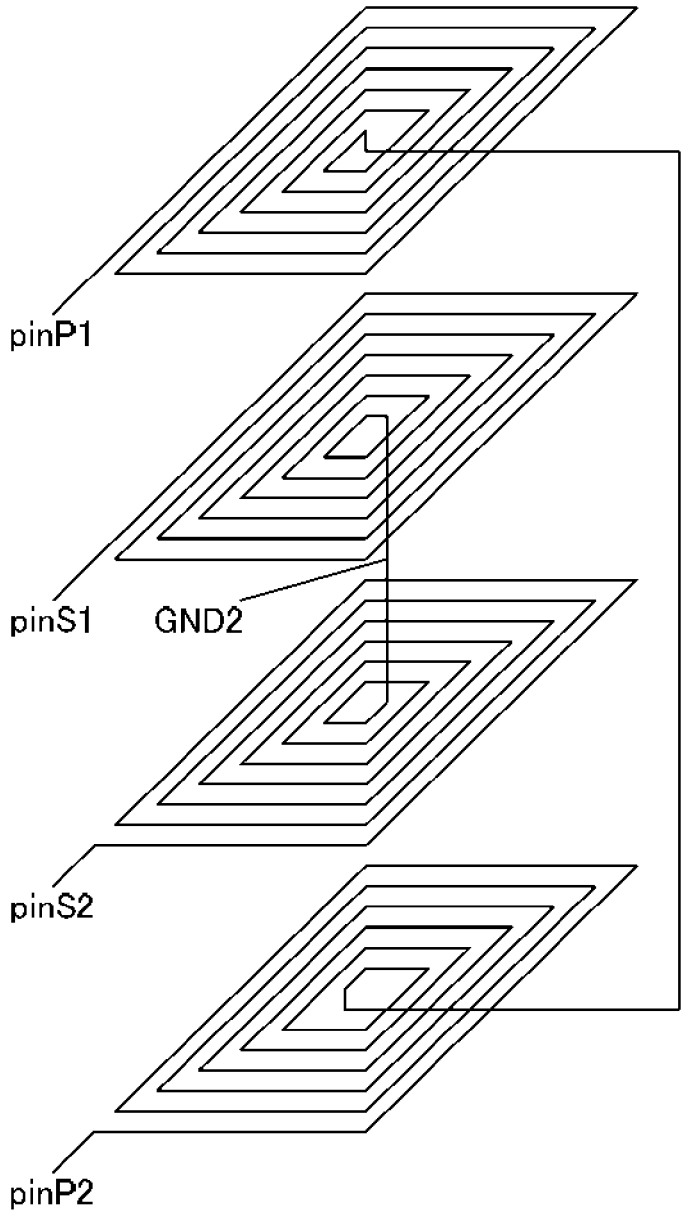
FIG. 6 is a view showing a configuration example (Example 3) in which a transformer in the second embodiment shown in FIG. 3 is made up of spiral coils.
Figure 7:
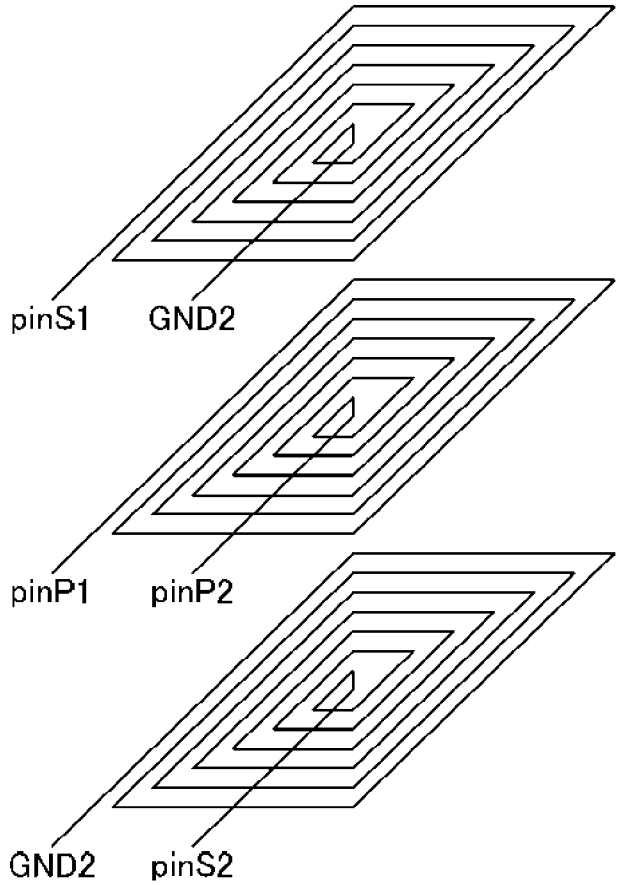
FIG. 7 is a view showing a configuration example (Example 4) in which a transformer in the second embodiment shown in FIG. 3 is made up of spiral coils.

FIG. 6 and FIG. 7 are views showing a configuration example 3 and a configuration example 4 in each of which the transformer according to the second embodiment shown in FIG. 3 is made up of spiral coils. Although each coil shown in each of FIGS. 6 and 7 has a rectangular coil pattern, it may have a circular, elliptical or polygonal coil pattern.

When the transformer made up of the coil patterns shown in each of FIGS. 4 to 7 is manufactured by a semiconductor technique, for example, the transformer can be formed in such a manner that the coil patterns are formed in three layers or four layers with interposition of an insulating layer between adjacent ones of the coil patterns.

Figure 8:
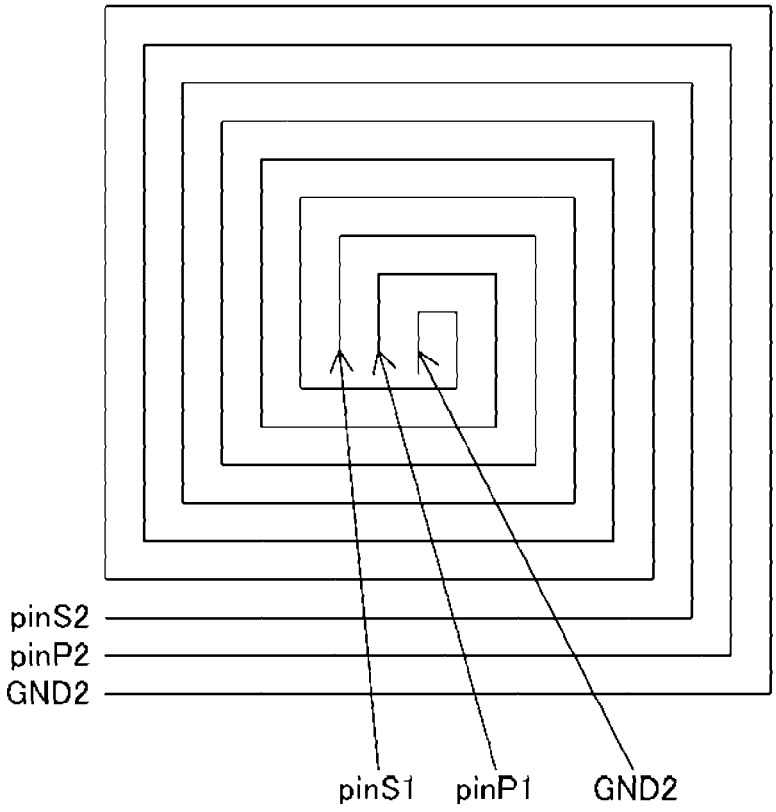
FIG. 8 is a view showing a configuration example (Example 5) in which a transformer in the second embodiment shown in FIG. 3 is made up of spiral coils.

FIG. 8 is a view showing a configuration example 5 in which the transformer according to the second embodiment shown in FIG. 3 is made up of spiral coils. Although each coil shown in FIG. 8 has a rectangular coil pattern, it may have a circular, elliptical or polygonal coil pattern. In addition, in FIG. 8, the sequence of the primary-side winding (pinP1, pinP2), the set-side secondary winding (pinS1, GND2), and the reset-side secondary winding (GND2, pinS2) may be changed. Further, the number of primary windings may be set as two or more. In this case, the primary windings, the set-side secondary winding and the reset-side secondary winding may be disposed alternately.

When the transformer made up of the coil patterns shown in FIG. 8 is manufactured by a semiconductor technique, for example, the transformer can be manufactured in such a manner that all the coil patterns are formed in the same layer. In this case, connection to pinS1, pinP1 and GND2 may be made by multilayer wiring. That is, the connection can be formed in such a manner that the coil patterns in FIG. 8 are covered with an insulating film, opening portions (also referred to as through holes) are formed in the insulating film immediately above pinS1, pinP1 and GND2, and pinS1, pinP1 and GND2 are connected to wiring of an upper layer through the opening portions. In addition, the connection to pinS1, pinP1 and GND2 may be made by bonding wires. Moreover, the connection to pinS1, pinP1 and GND2 may be made by external wiring of a printed circuit etc. Further, a not-shown connection portion connecting GND2 in two places (in the lower left and the center portions) in FIG. 8 corresponds to the intermediate tap in FIG. 3.

Figure 9:
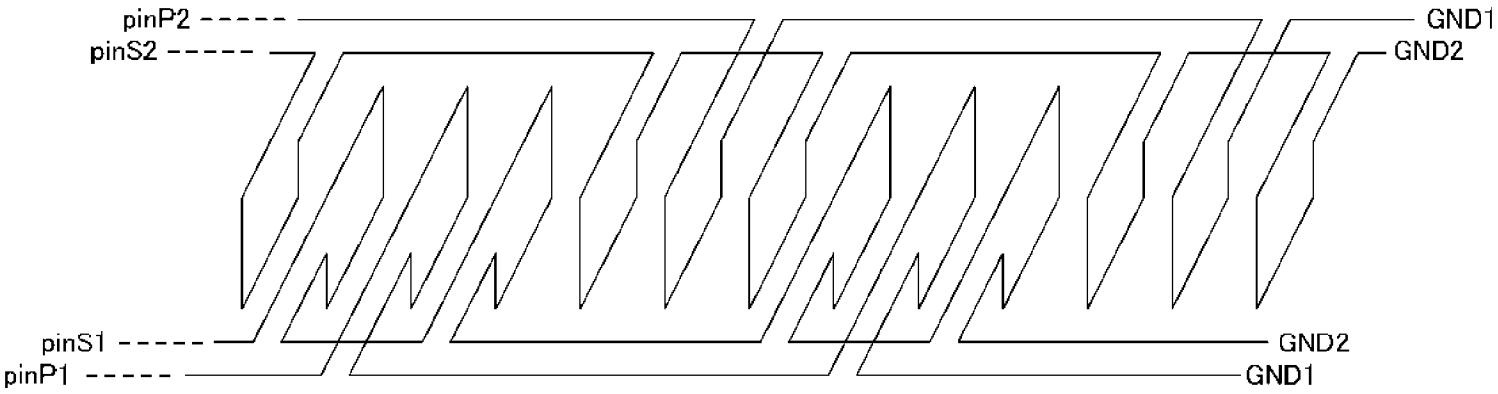
FIG. 9 is a view showing a configuration example (Example 6) in which a transformer in the first embodiment shown in FIG. 1 is made up of solenoid coils.

FIG. 9 is a view showing a configuration example 6 in which the transformer according to the first embodiment shown in FIG. 1 is made up of solenoid coils. Although each coil shown in FIG. 9 has a rectangular coil pattern, it may have a circular, elliptical or polygonal coil pattern.

Figure 10:
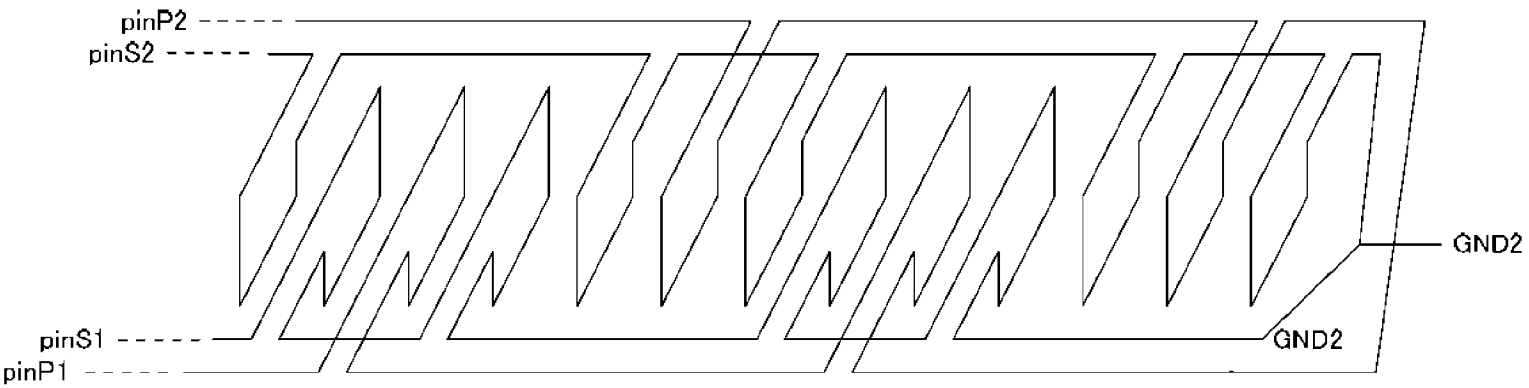
FIG. 10 is a view showing a configuration example (Example 7) in which a transformer in the second embodiment shown in FIG. 3 is made up of solenoid coils.
Figure 11:
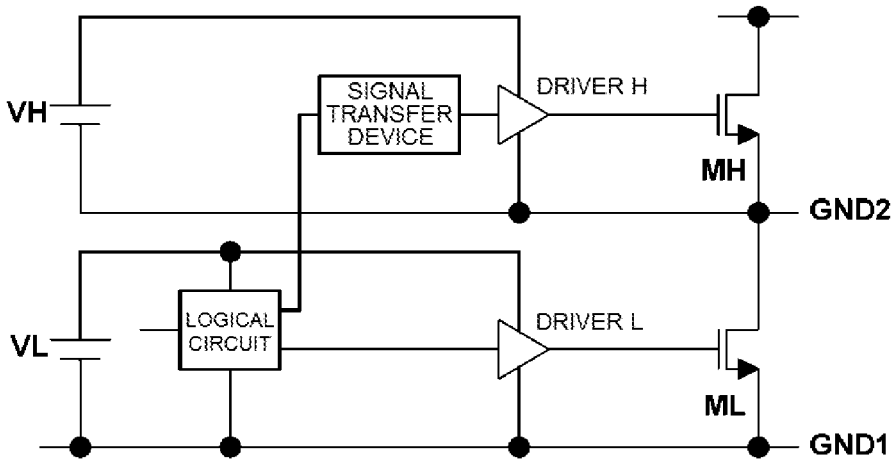
FIG. 11 PRIOR ART
FIG. 11 is a view showing a configuration example of a typical switching power supply constituted by semiconductor power switches one of which includes a signal transfer device transferring a signal through an insulating transformer.
Figure 12:
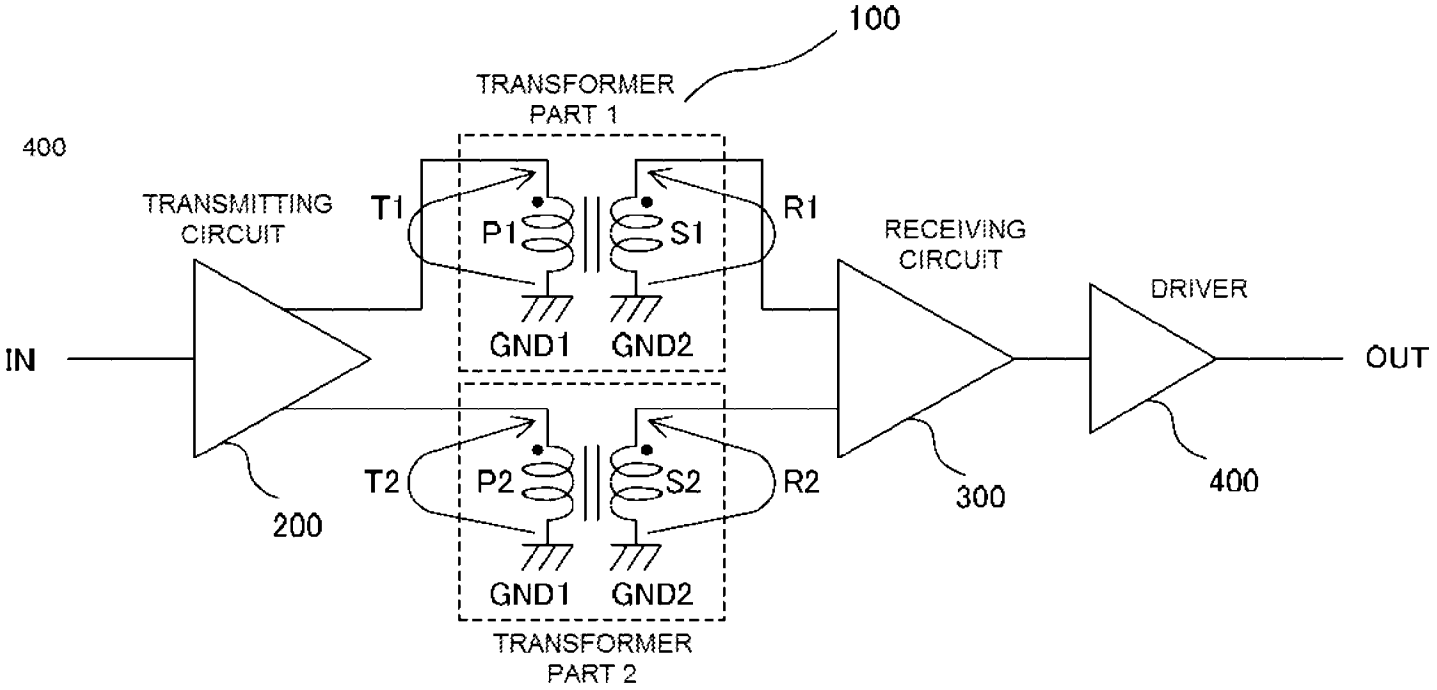
FIG. 12 PRIOR ART
FIG. 12 is a view showing the configuration of a background-art signal transfer device.
Figure 13:
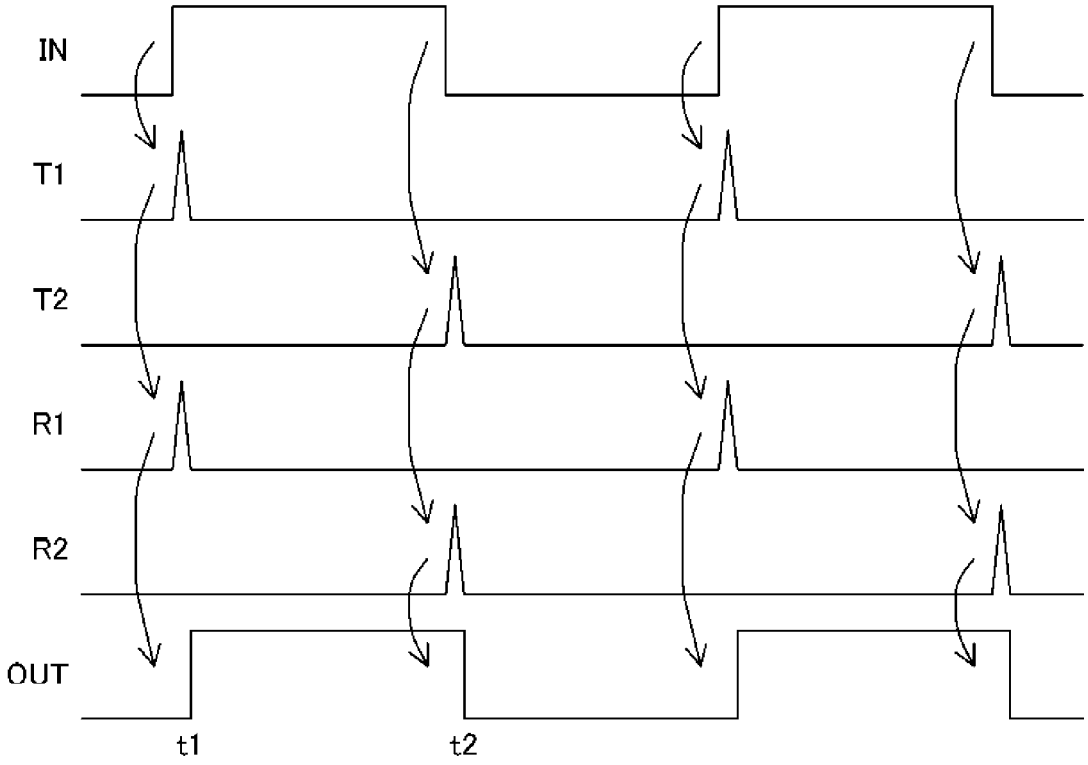
FIG. 13 PRIOR ART
FIG. 13 is a view showing an ideal operation waveform of the background-art signal transfer device shown in FIG. 12.

FIG. 10 is a view showing a configuration example 7 in which the transformer according to the second embodiment shown in FIG. 3 is made up of solenoid coils. Although each coil shown in FIG. 10 has a rectangular coil pattern, it may have a circular, elliptical or polygonal coil pattern.

What is claimed is:

1. A signal transfer device which transfers a signal through a transformer to a receiving circuit, the signal transfer device comprising:

a receiving circuit having a set-side input terminal and a reset-side input terminal; and a transformer having a first transformer part including a secondary-side winding connected to the set-side input terminal of the receiving circuit and having a second transformer part including a secondary-side winding connected to the reset-side input terminal of the receiving circuit, wherein the first transformer part and the second transformer part are magnetically coupled to each other so densely that a magnetic flux interlinking with one secondary-side winding interlinks with the other secondary-side winding; and the respective secondary-side windings are connected to the receiving circuit so that the set-side input terminal and the reset-side input terminal of the receiving circuit have magnetic polarities that are reverse to each other, wherein the secondary-side windings of the first transformer part and the second transformer part have respective signal terminals and ground terminals, and wherein the respective secondary-side windings of the first transformer part and the second transformer part are wound in a direction that is the same direction but the respective signal terminals and the respective ground terminals are reversed to each other so that the set-side input terminal and the reset-side input terminal of the receiving circuit have magnetic polarities that are reverse to each other.

2. The signal transfer device according to claim 1, wherein the transformer is made up of spiral coils that are rectangular spiral coils, circular spiral coils, elliptical spiral coils, or polygonal spiral coils.

3. The signal transfer device according to claim 1, wherein the transformer is made up of solenoid coils that are rectangular solenoid coils, circular solenoid coils, elliptical solenoid coils, or polygonal solenoid coils.

4. The signal transfer device according to claim 3, wherein the solenoid coils are laminated.

5. The signal transfer device according to claim 1, wherein the transformer includes a primary-side winding formed out of a single coil or a plurality of coils that are connected in series or in parallel.

6. The signal transfer device according to claim 5, wherein the transformer is made up of spiral coils that are rectangular spiral coils, circular spiral coils, elliptical spiral coils, or polygonal spiral coils.

7. The signal transfer device according to claim 5, wherein the transformer is made up of solenoid coils that are rectangular solenoid coils, circular solenoid coils, elliptical solenoid coils, or polygonal solenoid coils.

8. The signal transfer device according to claim 7, wherein the solenoid coils are laminated.

9. The signal transfer device according to claim 1, wherein the secondary-side windings of the first transformer part and the second transformer part have respective ends for which one respective end of each secondary-side winding is connected to the other to provide a connection point, and have respective another ends for which one respective another end is connected to the set-side input terminal and the other respective another end is connected to the reset-side input terminal of the receiving circuit, and wherein the transformer further comprises an intermediate tap provided at the connection point.

10. A signal transfer device which transfers a signal through a transformer to a receiving circuit, the signal transfer device comprising:

a receiving circuit having a set-side input terminal and a reset-side input terminal; and a transformer having a first transformer part including a secondary-side winding connected to the set-side input terminal of the receiving circuit and having a second transformer part including a secondary-side winding connected to the reset-side input terminal of the receiving circuit, wherein the first transformer part and the second transformer part are magnetically coupled to each other so densely that a magnetic flux interlinking with one secondary-side winding interlinks with the other secondary-side winding; and the respective secondary-side windings are connected to the receiving circuit so that the set-side input terminal and the reset-side input terminal of the receiving circuit have magnetic polarities that are reverse to each other, and wherein the secondary-side winding of the first transformer part and the secondary-side winding of the second transformer part are wound in reverse directions so that the set-side input terminal and the reset-side input terminal of the receiving circuit have magnetic polarities reverse to each other.

11. The signal transfer device according to claim 10, wherein the transformer is made up spiral coils that are rectangular spiral coils, circular spiral coils, elliptical spiral coils, or polygonal spiral coils.

12. The signal transfer device according to claim 10, wherein the transformer is made up of solenoid coils that are rectangular solenoid coils, circular solenoid coils, elliptical solenoid coils, or polygonal solenoid coils.

13. The signal transfer device according to claim 12, wherein the solenoid coils are laminated.

14. The signal transfer device according to claim 10, wherein the transformer includes a primary-side winding, and wherein the primary-side winding is formed out of a single coil or a plurality of coils that are connected in series or in parallel.

15. The signal transfer device according to claim 14, wherein the transformer is made up of spiral coils that are rectangular spiral coils, circular spiral coils, elliptical spiral coils, or polygonal spiral coils.

16. The signal transfer device according to claim 14, wherein the transformer is made up of solenoid coils that are rectangular solenoid coils, circular solenoid coils, elliptical solenoid coils, or polygonal solenoid coils.

17. The signal transfer device according to claim 16, wherein the solenoid coils are laminated.

18. The signal transfer device according to claim 1, wherein the transformer includes a primary-side winding having end terminals, wherein the primary-side winding is formed out of one coil, and wherein a signal transmitted to the set-side input terminal of the receiving circuit and a signal transmitted to the reset-side input terminal of the receiving circuit are inputted to opposite end terminals of the primary-side winding.

19. The signal transfer device according to claim 18, wherein the secondary-side windings of the first transformer part and the second transformer part have respective ends for which one respective end of each secondary-side winding is connected to the other to provide a connection point, and have respective another ends for which one respective another end is connected to the set-side input terminal and the other respective another end is connected to the reset-side input terminal of the receiving circuit, and wherein the transformer further comprises an intermediate tap provided at the connection point.

20. A signal transfer device which transfers a signal through a transformer to a receiving circuit, the signal transfer device comprising:

a receiving circuit having a set-side input terminal and a reset-side input terminal that have respective magnetic polarities that are reverse to each other; and a transformer having a first transformer part and a second transformer part that are magnetically coupled to each other, the first transformer part including a secondary-side winding connected to the set-side input terminal of the receiving circuit and the second transformer part including a secondary-side winding connected to the reset-side input terminal of the receiving circuit so that a magnetic flux interlinking with one secondary-side winding interlinks with the other secondary-side winding, wherein the secondary-side winding of the first transformer part and the secondary-side winding of the second-transformer part are wound in reverse directions so that the set-side input terminal and the reset-side input terminal of the receiving circuit have magnetic polarities reverse to each other, or wherein the secondary-side winding of the first transformer part and the secondary-side winding of the second transformer part each have a signal terminal and a ground terminal, and the respective secondary-side windings of the first transformer part and the second transformer part are wound in a direction that is the same direction but the respective signal terminals and the respective ground terminals are reversed to each other so that the set-side input terminal and the reset-side input terminal of the receiving circuit have magnetic polarities that are reverse to each other.

* * * * *